US006164976A

United States Patent [19]

Wilson

[11] Patent Number: 6,164,976

[45] Date of Patent: Dec. 26, 2000

[54] CREATIVITY CENTER APPARATUS AND METHOD FOR USE

[75] Inventor: Martin Wilson, Holland, N.Y.

[73] Assignee: Mattel, Inc., El Segundo, Calif.

[21] Appl. No.: 09/244,118

[22] Filed: Feb. 4, 1999

[51] Int. Cl.[7] ..... B43L 1/00

[52] U.S. Cl. ..... 434/414; 434/365; 434/408

[58] Field of Search ..... 434/365, 408, 434/413, 414, 417, 419, 420, 424, 425, 430, 192; 281/45, 50, 49, 51

[56] References Cited

U.S. PATENT DOCUMENTS

| | | | |
|---|---|---|---|
| 253,514 | 2/1882 | Cooke . | |
| 1,015,498 | 1/1912 | Kraus | 434/430 |
| 1,512,827 | 10/1924 | Deutsch . | |
| 1,958,579 | 5/1934 | Johnson et al. | 35/15 |
| 2,116,989 | 5/1938 | Unger et al. | 281/50 |
| 2,161,587 | 6/1939 | Pettis | 25/63 |
| 2,167,296 | 7/1939 | Farmer | 15/97 |
| 2,359,195 | 9/1944 | Berliner et al. | 36/66 |
| 2,726,460 | 12/1955 | Jecmen | 35/62 |
| 2,917,837 | 12/1959 | Hoeltje | 35/62 |
| 3,163,943 | 1/1965 | Bell | 36/62 |
| 3,774,418 | 11/1973 | Cooper | 434/430 |
| 3,838,520 | 10/1974 | Quenot | 33/138 |
| 4,143,472 | 3/1979 | Murata et al. | 35/66 |
| 4,427,391 | 1/1984 | Berman | 434/408 |
| 4,834,334 | 5/1989 | Robins | 248/441.1 |
| 4,896,927 | 1/1990 | Liu et al. | 312/190 |
| 4,960,383 | 10/1990 | Smith et al. | 434/430 |
| 4,968,258 | 11/1990 | Kees | 434/365 |
| 5,163,845 | 11/1992 | Blassingame | 434/408 |
| 5,213,504 | 5/1993 | Lee et al. | 434/84 |
| 5,284,445 | 2/1994 | Dietterich et al. | 434/419 |
| 5,324,202 | 6/1994 | Meyers et al. | 434/410 |
| 5,409,383 | 4/1995 | Mannino | 434/414 |
| 5,785,528 | 7/1998 | Jones-Fenleigh et al. | 434/88 |
| 5,938,449 | 8/1999 | Masson et al. | 434/408 |

FOREIGN PATENT DOCUMENTS

| | | |
|---|---|---|
| 0 730 983 A1 | 9/1996 | European Pat. Off. . |
| 19651 | 10/1882 | Germany . |

OTHER PUBLICATIONS

Tyco advertisement, Creative Art Center.

International Search Report (PCT/US00/02694), European Patent Office, mailed Jun. 29, 2000.

*Primary Examiner*—Sam Rimell

*Attorney, Agent, or Firm*—Morgan, Lewis & Bockius LLP

[57] ABSTRACT

A creativity center includes a base portion that is connected by a hinge to a board that has opposed drawing/design surfaces on which artistic designs and markings can be made. The board can rotate with respect to the base via the hinge and can be slid with respect to the hinge such that the board can be repeatedly flipped over and slid between two opposed "use" positions with respect to the base. Thus, an opposed drawing/design surface configured in a "use" position is presented to a user each time the board is flipped over. An eraser can be located on either the base or on the hinge to automatically remove designs or markings located on the board when the board is slid through the hinge. In addition, the base can include a storage compartment for storing art supplies.

31 Claims, 8 Drawing Sheets

CREATIVITY CENTER APPARATUS AND METHOD FOR USE

FIELD OF THE INVENTION

The invention relates to drawing or creativity devices, and more particularly, to a child's creativity center that includes a two-sided drawing/design board movable with respect to a base to selectively position both sides of the board for use and that optionally includes an erasing mechanism to selectively erase each side of the board.

BACKGROUND OF THE INVENTION

A variety of creativity centers or drawing aids or devices have been proposed for use by users, especially children, to paint, draw, or engage in other creative activities. It is common to include a planar surface or board to which the user can directly apply decorations or creations or on which the child can place a sheet of paper or other medium on which to apply decorations or creations.

Some proposed drawing devices include multiple drawing surfaces that can be selectively disposed in a position in which the user can work on a selected surface. For example, U.S. Pat. No. 5,163,845 to Blassingame discloses a visual aid device that includes a frame into which can be placed a flat, two-sided board. The board can be placed in the frame with either side facing outwardly for use. To reverse the board surface, the board must be slid free from the frame, reversed, and slid back into the frame. U.S. Pat. No. 1,958,579 to Johnson discloses a blackboard device with multiple blackboard panel hinged about a common vertical axis. A user can draw on one side of a hinged panel, then rotate the panel 180° about the axis so that its opposite surface is presented, then draw on the opposite surface.

It is desirable to be able to erase or otherwise remove the user's work from the drawing surface, and suitable erasing for the various media (chalk, pencil, marker, etc.) are known. It is preferable that the drawing device include an erasing mechanism that is coupled to the drawing device so that it is not separated and lost and that facilitates easy use by the user. Several proposed drawing devices include such erasing mechanisms. For example, U.S. Pat. No. 2.359,195 to Berliner discloses an erasable writing pad in which images can be drawn by pressing a transparent top film onto a black wax surface. A parting member disposed between the film and the wax surface can be slid along the length of the pad to separate the sheet from the wax, erasing the image. The film and wax surface are mounted together for sliding movement in a frame, and the parting member is fixed to the frame, so that when the film and wax surface are slid outwardly from the frame, the parting member separates the film from the wax surface.

Similarly, U.S. Pat. No. 3,838,520 to Quenot discloses an eraser built into a sketch pad located on the side of a tape measure. The sketch pad includes an outer sheet, a backing sheet and an intermediate sheet that are configured such that when pressure is applied against the outer sheet, the backing and intermediate sheets adhere to each other and leave a visible trace. The eraser is formed as a strip 40 located between the backing sheet and the intermediate sheet to separate the backing and intermediate sheets as they are drawn past the eraser strip 40 and to thereby remove any markings on the sheets.

Another example, in which the erasing mechanism is moved with respect to a fixed drawing surface, rather than moving the drawing surface with respect to a fixed erasing mechanism as in Berliner and Quenot, is disclosed in U.S. Pat. No. 2,167,296 to Farmer. A movable part 18 is mounted for linear movement with respect to a fixed chalk board 6. The movable part includes erasers mounted to bear against the surface of the chalk board. When the movable part is moved across the surface of the chalk board, any markings on the board are erased.

Drawing devices have also been proposed than include storage for drawing implements (markers, pens, etc.), such as in a compartment that is covered by a drawing board and is accessible by moving the drawing board away from the compartment. One example is disclosed in U.S. Pat. No. 5,284,445 to Dietterich.

The drawing devices described above suffer from several shortcomings. Although the devices of Blassingame and Johnson provide two-sided boards on which a user can draw, Blassingame's board is separate from its supporting structure and can therefore become separated and lost, and Johnson's board requires a support structure at least twice the size of the drawing board, since the board is pivoted about a centrally-mounted hinge. The hinged board of Johnson is movable only by pivoting, and the board of Blassingame is movable only by sliding. The devices of Berliner and Quenot include useful erasing devices, but do not include two-sided boards. These devices lack the storage compartment of Dietterich, which in turn lacks a two-sided board and an erasing mechanism.

SUMMARY OF THE INVENTION

The drawbacks of the known drawing devices are overcome by the disclosed activity center. The activity center includes a base and a drawing or design board that is hinged to the base for rotational movement with respect to the base. The board is also mounted to move with respect to the hinge. Several implementations of, and variations on, this basic concept are possible. The base can include a storage compartment, such as for drawing implements, that is covered by the board. The compartment can be accessed by rotating the board about the hinge, or by sliding the board with respect to the hinge and the body. The board can be two-sided, and moved from a use position in which one side of the board is facing outwardly from the base by rotating the board about the hinge, then slid with respect to the hinge so that the board can be disposed in the use position with the opposite side of the board facing outwardly.

Further, an erasing mechanism can be incorporated into the activity center and arranged so that at least one surface of the board is erased by the eraser when the board is moved with respect to the hinge. The eraser can be mounted to the hinge and arranged to bear against a single drawing surface of a one-sided board or against either or both drawing surfaces of a two-sided board. The eraser can alternatively be mounted to the base and arranged to bear against either drawing board surface(s).

DETAILED DESCRIPTION OF PREFERRED EMBODIMENTS

The creativity center of the invention can be considered to include three functional elements: a base, a board, and a hinge by which the board is mounted to the base. The hinge permits pivotal movement of the board with respect to the body between a "use" position in which the board is disposed with one side or surface facing upwardly, or away from the body, and is securely supported on the body so that the user can work on the upward facing surface. The board is also movable with respect to the hinge so that the board can be moved away from the use position without rotating the hinge. The board can, for example, slide with respect to the hinge. The board can also be inverted from the use position to an alternative use position in which the opposite side or surface of the board faces upwardly by rotating the board with respect to the body on the hinge and sliding the board with respect to the hinge. The base can include a storage compartment closed by the board when the board is in the use position and opened by rotating the board away from the body about the hinge or by sliding the board with respect to the hinge.

Figure 1:
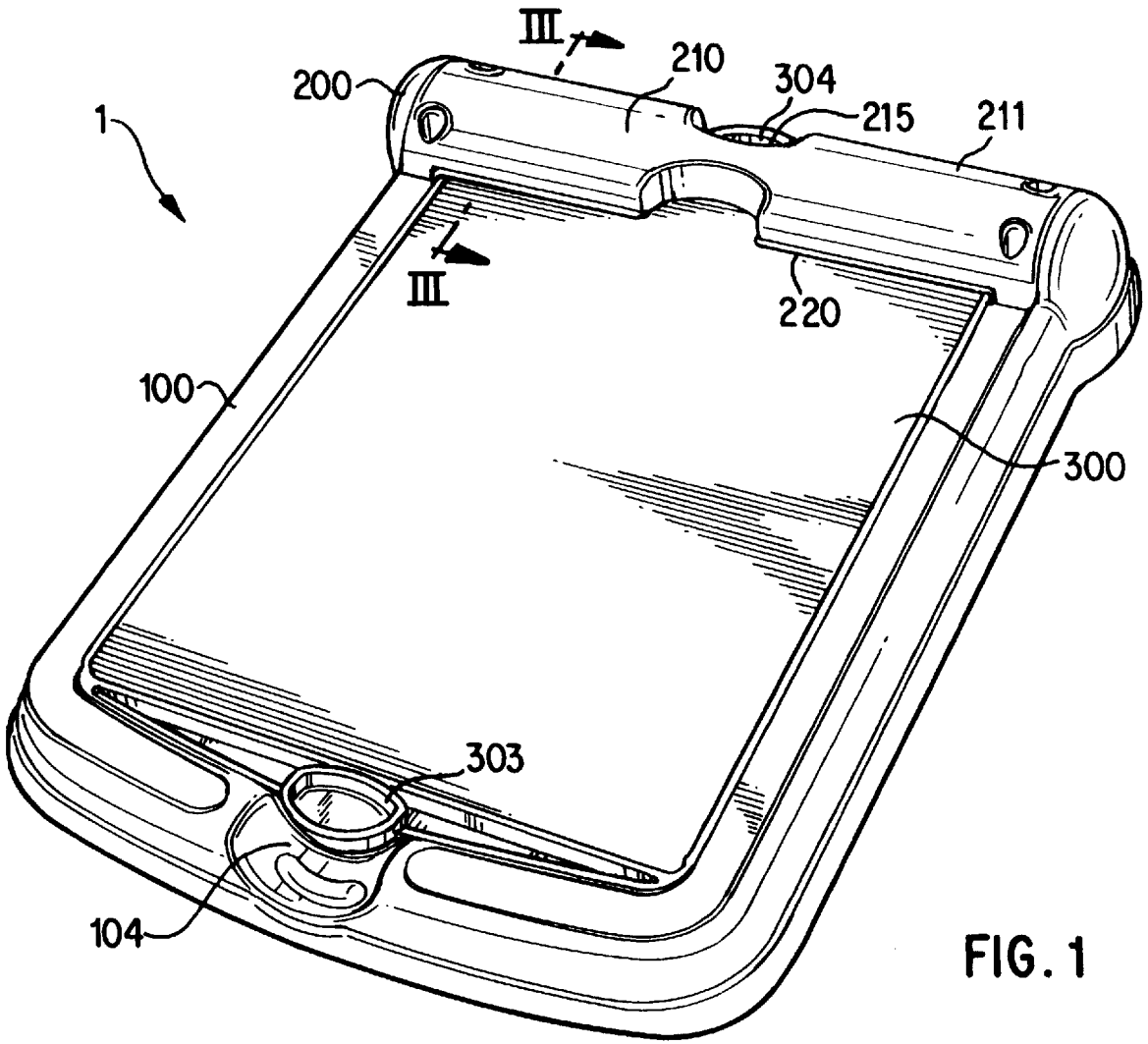
FIG. 1 is a perspective view of a creativity center embodying the principles of the invention.

One implementation of a creativity center incorporating the inventive concepts identified above is illustrated in FIGS. 1–8. As shown in FIG. 1, creativity center 1 includes a base 100 and a board 300 coupled to base 100 by a hinge 200. The hinge 200 supports board 300 for rotation with respect to base 100 and for translation with respect to the hinge.

Figure 2:
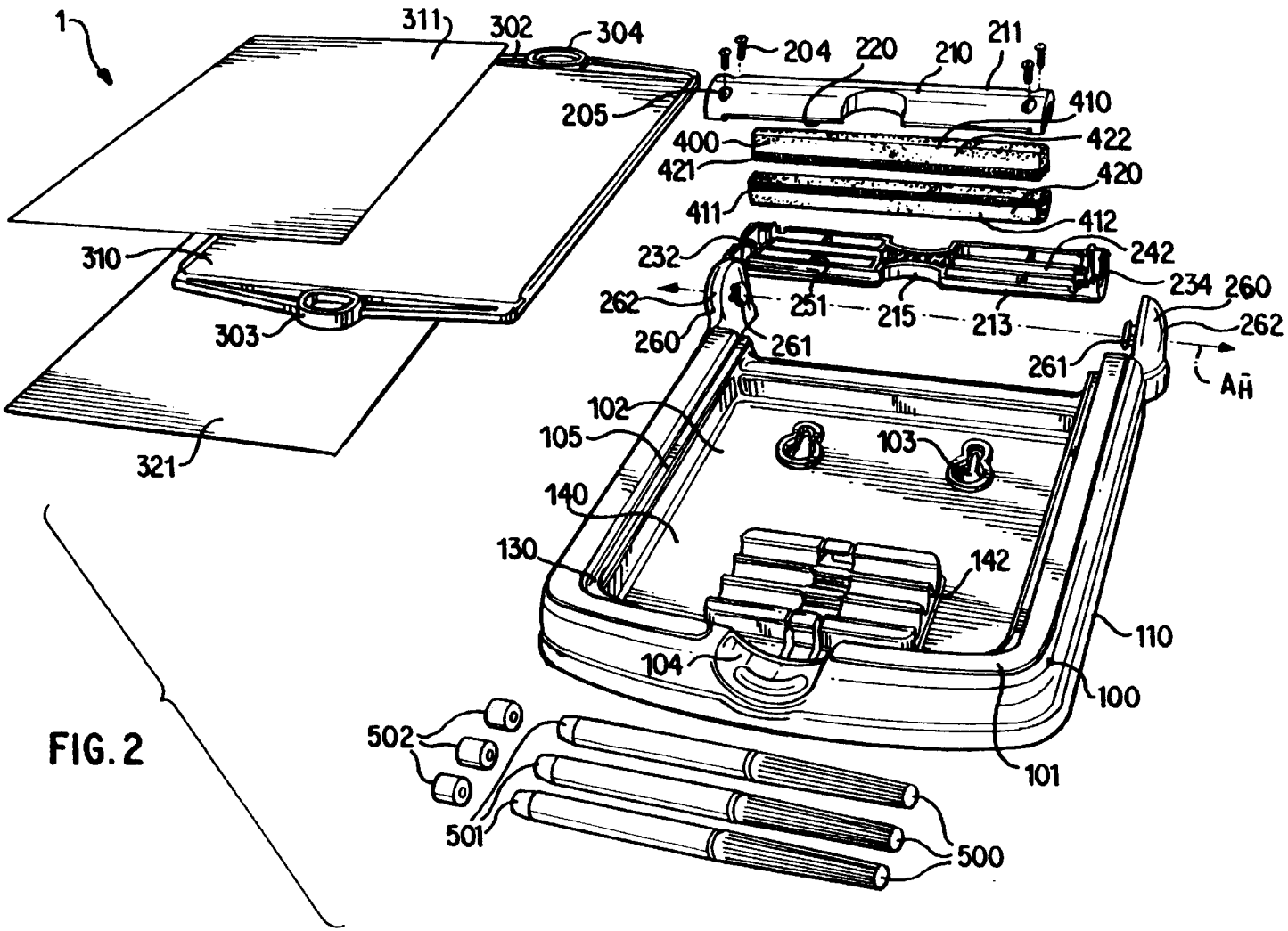
FIG. 2 is an exploded view of the creativity center of FIG. 1.

As shown in FIG. 2, board 300 is generally rectangular and planar, with parallel, planar first and second faces 310 and 320, respectively, and left and right handles 303, 304. In the illustrated embodiment, board 300 is formed with a board frame 302 and with work surfaces 311, 321 supported on the board frame. The illustrated work surfaces 311, 321 are dry erase marker surfaces ("white boards") adhered to first and second faces 310, 320. Surfaces 311, 321 can include permanent surface graphics or designs, such as cartoon characters that a child might try to recreate through a drawing or other design on the drawing/design surface, and/or alphabetic and numeric characters, company logos, etc. Surfaces 311, 321 can also be blank.

Base 100 includes a lower portion 110 that engages a supporting surface for the creativity center, such as a table top or a vertical wall. Base 100 also includes a hinge mounting portion 120 to which hinge 200 is mounted, a board supporting portion 130 that supports board 300 in a use position, and a storage compartment 140 in which supplies such as drawing tools can be stored. In the illustrated embodiment, base 100 is formed as a unity, single-walled, molded plastic part, with a peripheral frame 101 that is U-shaped in plan and inverted-U-shaped in cross section. Hinge mounting portion 120 is disposed at the open end of the U. Frame 101 borders a generally planar inside face 102 of base 100, and a storage compartment 140 is defined between frame 101 and inside face 102. Inside face 102 includes hanger apertures 103 by which the creativity center can be mounted on a vertical surface such as a wall, or otherwise secured to a stationary surface.

The upper and inner edge 105 of peripheral frame 101 forms part of board supporting portion 130, supporting the rim of board 300. A handle recess 104 is formed at the closed end of the U of the peripheral frame 101 to allow the user to insert a hand between board 300 and peripheral frame 101.

Figure 6A:
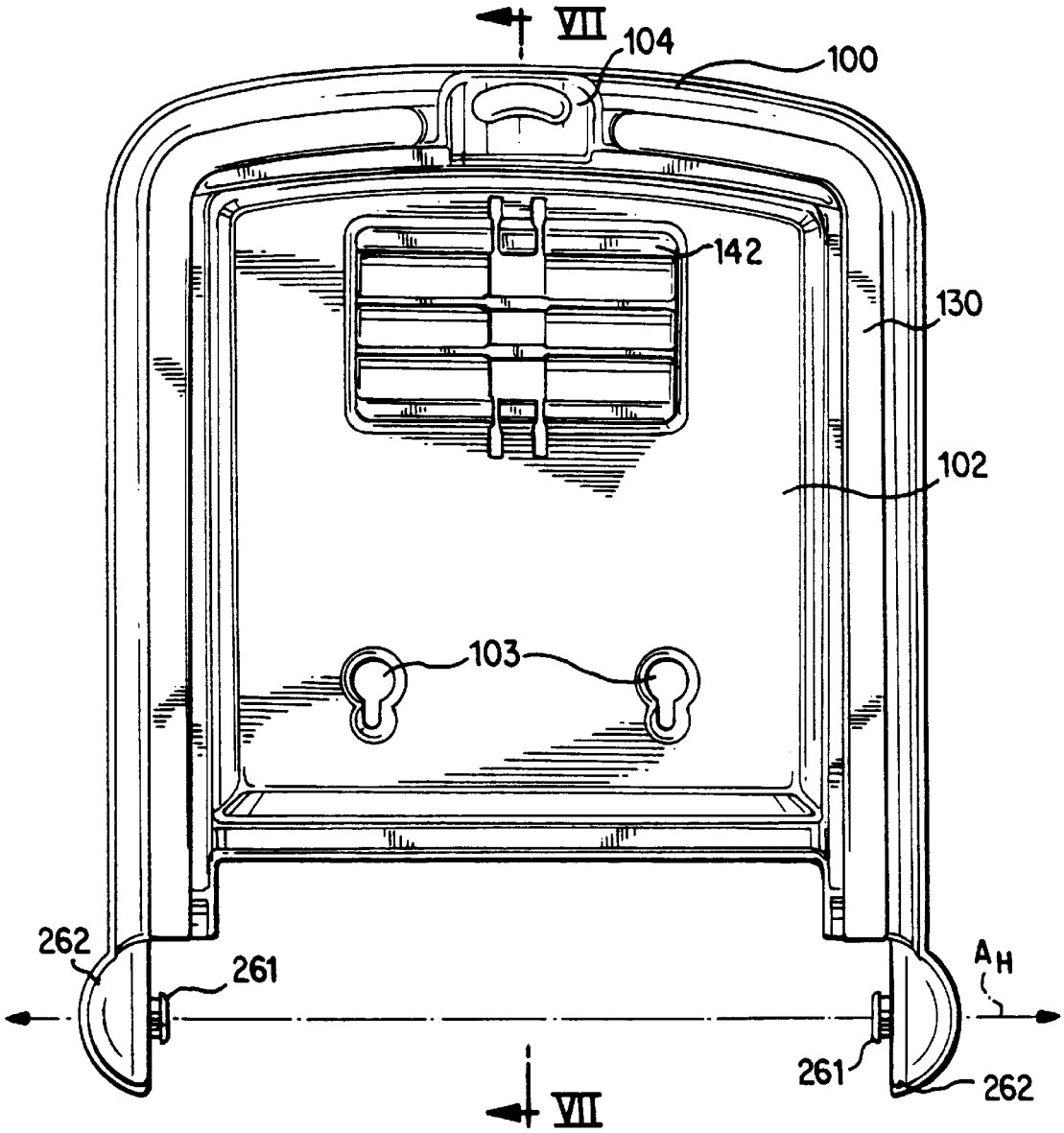
FIGS. 6A–6B are front and top views, respectively, of the base shown in FIG. 1.
Figure 6B:
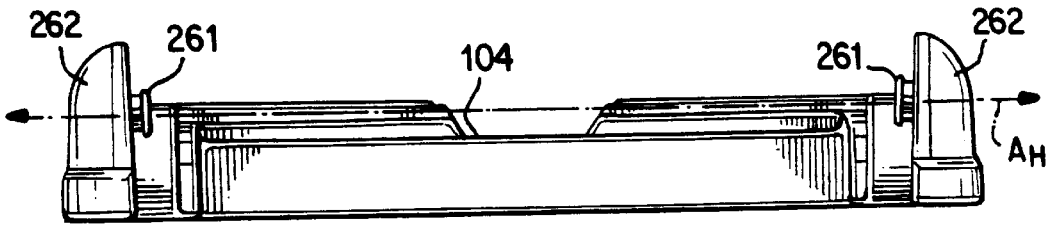
Figure 7:
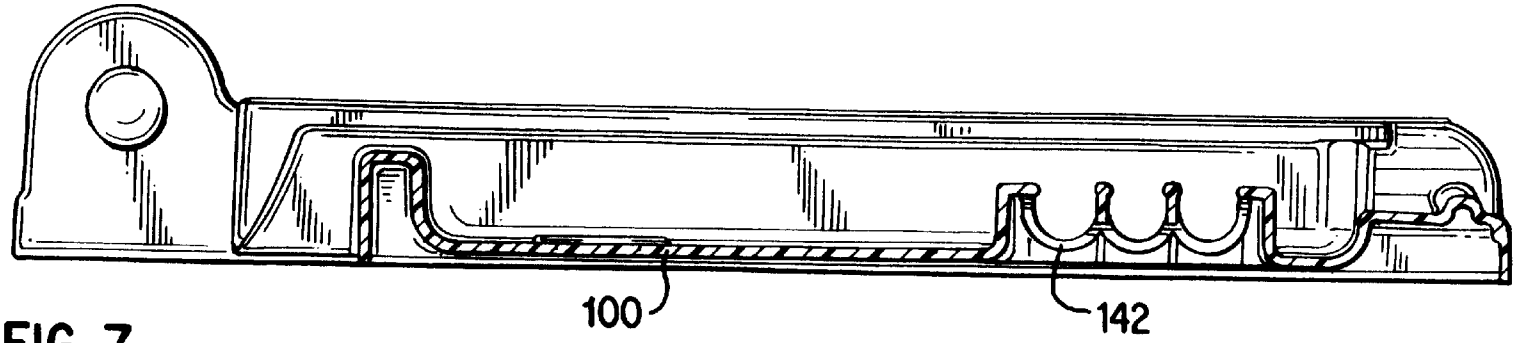
FIG. 7 is a cross-sectional view taken along lines VII—VII of FIG. 6A of the base shown in FIG. 1.

Storage compartment 140 includes clips 142 (as best shown in FIGS. 6A–7) which frictionally engage markers, pens or other drawing implements to secure them within the storage compartment 140. In the illustrated embodiments, the drawing implements are dry-erase markers 500, which include individual erasers 501 disposed on the end of the marker barrel opposite the drawing tip (concealed by caps 502).

Figure 8:
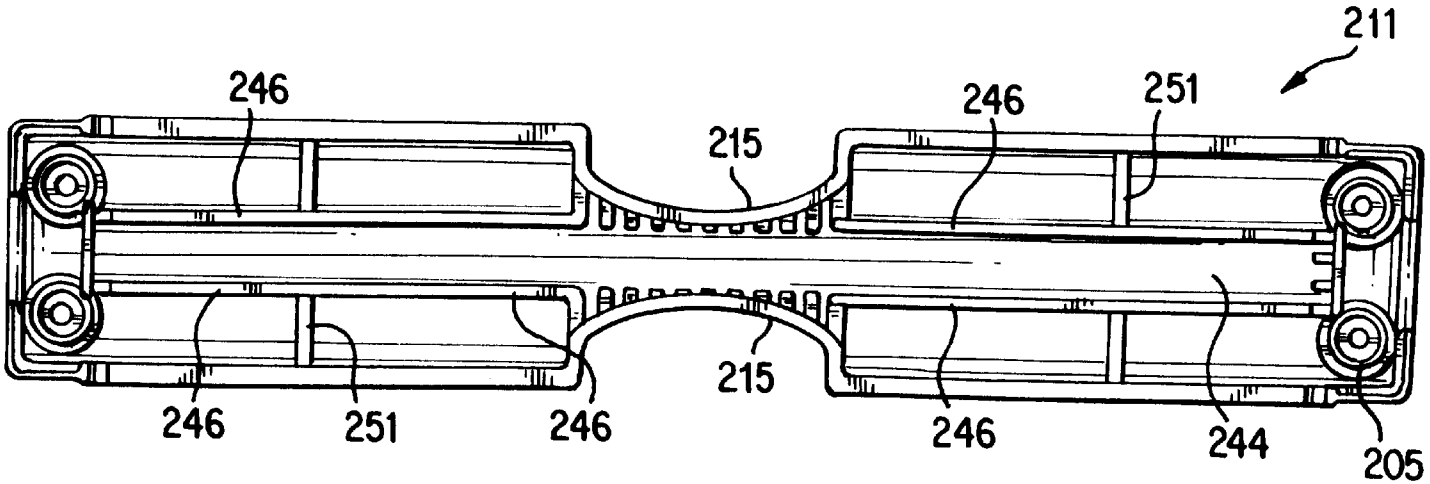
FIG. 8 is a bottom view of the hinge half shell shown in FIG. 1.

Hinge 200 rotatably and movably couples board 300 to base 100. In the disclosed embodiment, as best seen in FIG. 2, hinge 200 is implemented as a barrel-type hinge at one end of the base. Hinge 200 includes a barrel shaped hinge body 210 and is mounted to barrel support 260. Hinge body 210 is formed of two hinge body half shells 211, 213 coupled by suitable fasteners, which in the illustrated embodiment are screws. Other mechanical fasteners, adhesives, etc. would also be suitable. Screw holes 205 are counter-sunk into the half shells 211, 213 to provide an aesthetically pleasing surface on the hinge barrel. Half shells 211, 213 define between them an elongate board slot 220, pin cavities 232, 234, and each include an eraser cavity 242, 244 defined in part by eraser support flanges 246. Cross bracing 251, best seen in FIG. 8, provides rigidity to the half shell structures and partially defines the pin and eraser cavities. Arcuate handle recesses 215 are formed at the center of hinge body 210.

Barrel support 260 includes support bosses 262 formed at the ends of peripheral frame 101. Each support boss 262 includes a hinge pin 261 that project laterally inwardly toward the centerline of base 100. Hinge body 210 is supported on support bosses 262 with pins 261 disposed in pin cavities 232, 234. Hinge body 210 is thus freely rotatable 360° about a hinge axis $A_H$ running through the centers of pins 261.

The board 300 is mounted in board slot 220, which is positioned through the center of the hinge 200, parallel to hinge axis $A_H$. Board slot 220 is dimensioned to permit board 300 to slide freely through slot 220 in directions perpendicular hinge axis $A_H$. Handles 303, 304 are thicker than the body of the board and the width of slot 220, and therefore prevent board 300 from sliding free of slot 220. Board 300 is thus movable through a range of motion bounded by end positions in which left and right handles 303, 304 are nested in their respective handle recesses 215.

Eraser 400 is mounted in hinge body 210 and disposed to erase markings, designs, or renderings on the work surfaces 311, 321 when board 300 is slid through board slot 220. Eraser support flanges 206 can be provided along the longitudinal length of each of the half shells 211 and 213 of hinge 200 to secure the eraser 400 therein.

Figure 3:
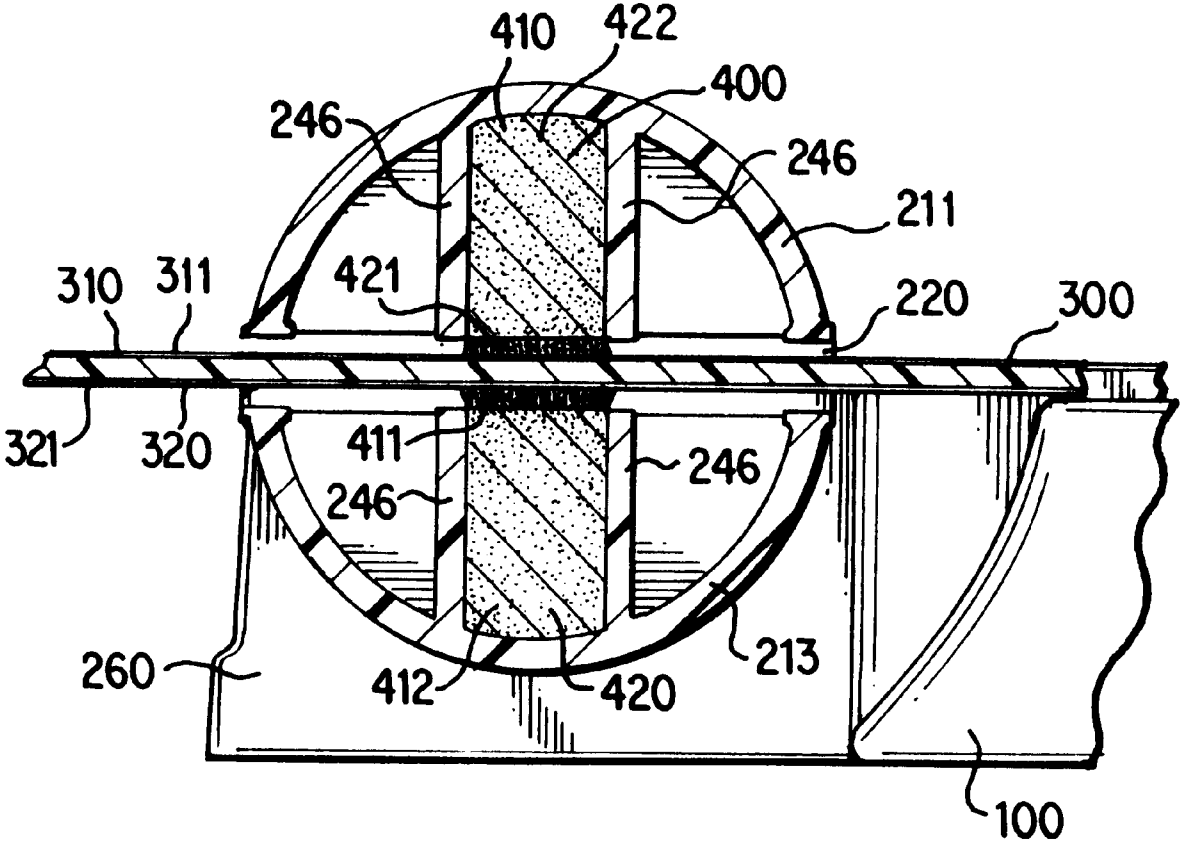
FIG. 3 is a cross-sectional view taken along line III—III of FIG. 1.

As shown in FIG. 3, an eraser 400 is provided in both the upper half shell 211 and lower half shell 213 of the hinge 200. In the illustrated embodiment, eraser 400 includes upper and lower erasing elements 410, 420, respectively. Erasing elements 410, 420 include erasing surfaces 411, 421, formed of suitable eraser material, and a biasing element 412, 422, respectively. In the illustrated embodiment, the eraser material is felt and the biasing elements are formed of a resilient polymer foam bonded to the erasing surfaces. In a preferred embodiment, the biasing elements 412, 422 comprise coil springs oriented vertically to bias the erasing surfaces 411,421 outward.

The erasing elements 410, 420 are disposed in eraser cavities 242, 244, respectively, with erasing surfaces 411, 421 biased radially inwardly by biasing elements 412, 422 to extend slightly proud of the radially inner edges of support flanges 246 into slot 220 for compressed contact with work surfaces 311, 321, respectively. Accordingly, board 300 is centered in slot 220 by the eraser 400, and when board 300 is slid through slot 220, erasing surfaces 411, 421 are simultaneously slid across work surfaces 311, 321 with a pressure sufficient to remove any marking or design located on the work surfaces.

Figure 4A:
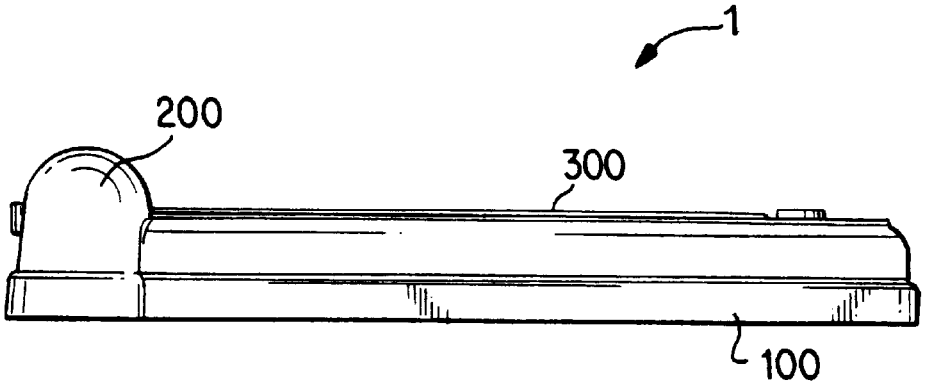
FIGS. 4A–4E are sequential operational side views of the creativity center of FIG. 1
Figure 4B:
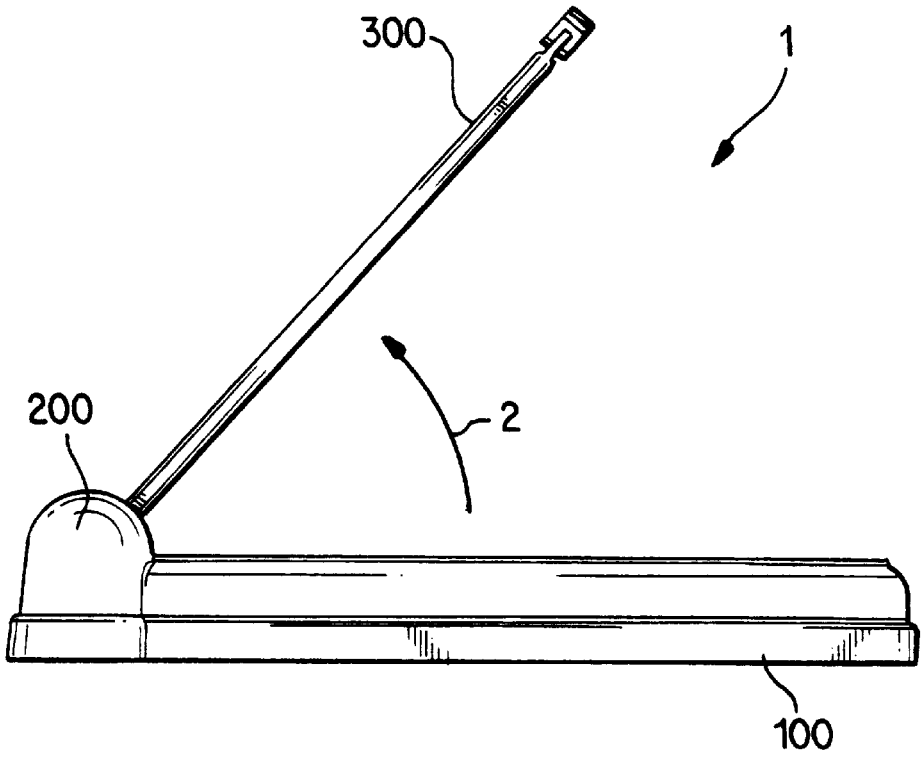
Figure 4C:
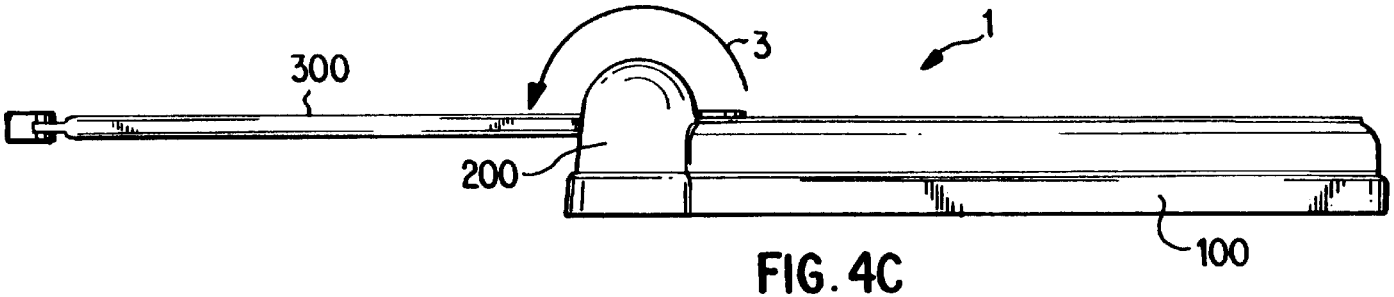
Figure 4D:
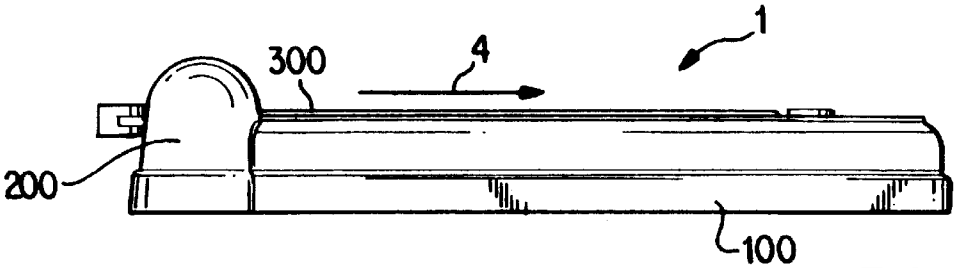

The operation of the creativity center 1 is described with references to FIGS. 4A–4E, which depict one operational sequence in which the creativity center can be used. In this sequence of operation, the user first disposes the board in a first "use" position (shown in FIG. 4A) by pulling board 300 to one end of its range of motion through slot 220, so that left handle 303 is disposed in a handle recess 215, and by rotating board 300 and hinge body 210 about hinge axis $A_H$ so that board 300 is disposed with its periphery engaging board support portion 130 of body 100, and with work surface 211 facing upwardly, away from base 100. The user may then create a design or marking on work surface 211 (FIG. 4A), such as with markers 500. When the user is finished creating the design on the board 300, the user can "flip" board 300 by rotating it and hinge body 210 about hinge axis $A_H$ away from the base 100 (as shown by arrow 2 in FIG. 4B). When the board has been rotated approximately 180° (as shown in FIG. 4C by arrow 3) the user can then grasp the right handle 304 (now disposed to the left of hinge axis $A_H$) and push board 300 through slot 220 (as shown by arrow 4) into a second use position (shown in FIG. 4D) with right handle 304 disposed in handle recess 215, with board 300 again disposed with its periphery engaging board support portion 130 of body 100, but with work surface 221 facing upwardly, away from base 100. (FIG. 4D). Thus, the board 300 is substantially identically positioned with respect to the base in the second use position, at the end of the sequence of operation, as it was in the first use position except that it has been "flipped" over, e.g., its opposed work surfaces 311, 321 face in a direction 180° from the direction in which they previously faced.

Figure 4E:
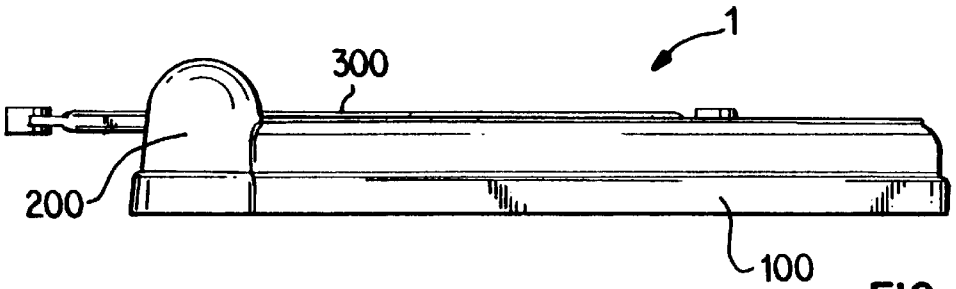

The operational sequence of flipping board 300 with respect to base 100 between its first and second use positions can be varied. For example, board 300 can be slid from the first use position through hinge slot 220 first, and then rotated with hinge body 210 180° clockwise back onto base 100 into second use position. The board may be disposed in other positions with respect to base 100 by partial movement or partial rotation of the board 300. For example, storage compartment 140 can be accessed either by sliding board 300 partially through slot 220 (as shown in FIG. 4E) a sufficient distance to access the storage compartment. The board may also be used in the this partially-displaced position, which can be considered as another use position. The storage compartment can also be accessed by partially rotating board 300, or by a combination of linear and rotational motion.

Figure 5:
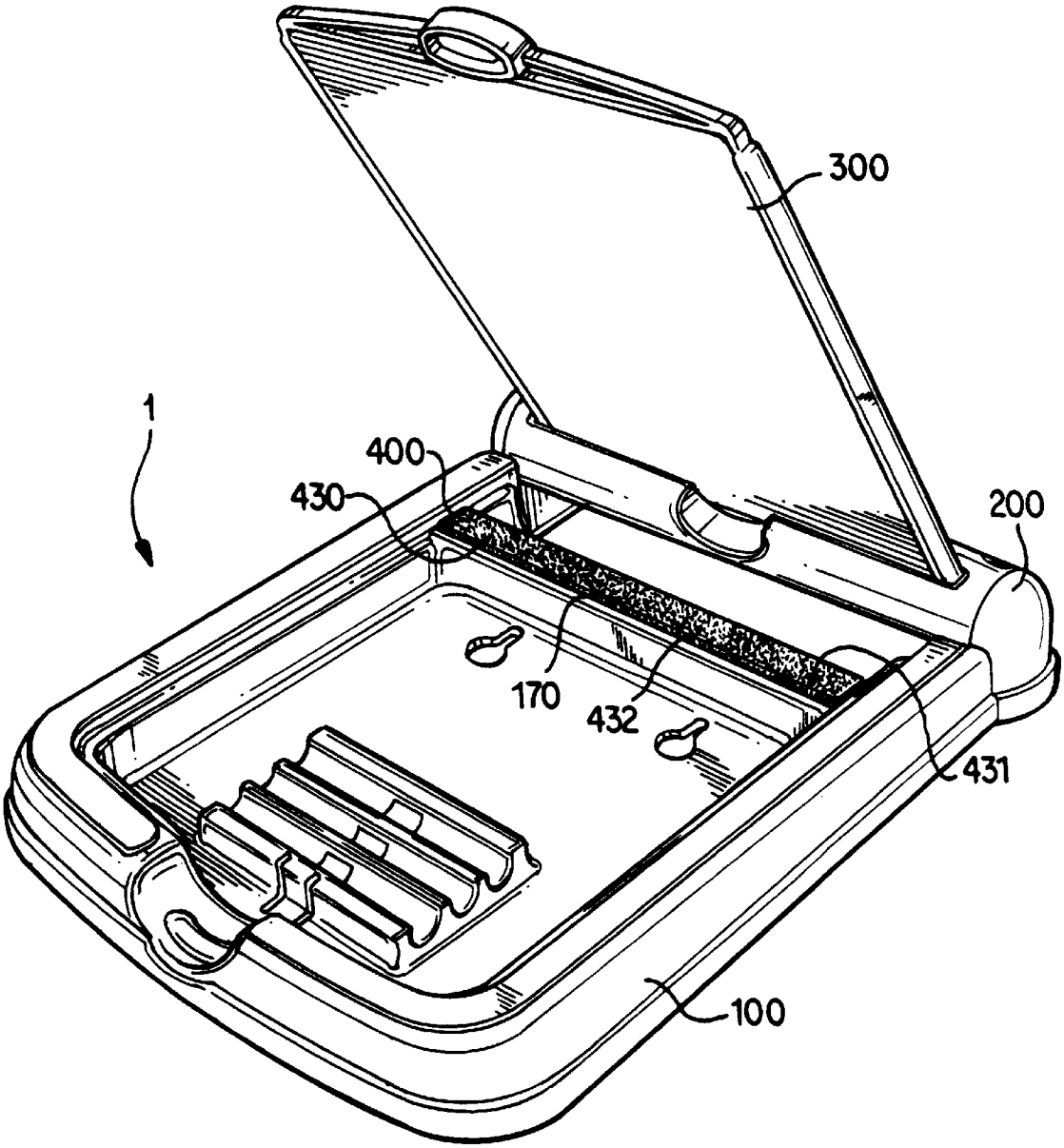
FIG. 5 is a perspective view of an alternative embodiment of the creativity center embodying the principles of the invention.

An alternative implementation of the concepts of the invention is shown in FIG. 5. In this implementation or embodiment, eraser 400 is fixed with respect to the base, rather than with respect to hinge body 210. Thus eraser 400 includes an eraser element 430 with an erasing surface 431 and a resilient member 432, of similar construction to the eraser elements 410, 420 of the previous embodiment. Eraser element is mounted in an eraser recess 170 formed in base 100 and is disposed to contact the work surface 311, 321 that faces downwardly, toward the base. In this embodiment, only the lower work surface will be erased if the board is slid through board slot 220 when hinge body 215 is oriented in the 0° or 180° positions (as shown in FIG. 3) with respect to the base 100.

Many variations on the disclosed embodiments are contemplated. Although hinge 200 is implemented in the illustrated embodiments as a barrel type hinge, many other suitable hinge structures will be apparent to the artisan. The hinge need only provide a rotational support for the board so that the board can be rotated with respect to the body and can be moved with respect to the hinge. In the illustrated embodiment, hinge body 215 spans the full width of board 300. Alternatively, hinge 200 could include two separate hinge elements, one at each side of body 100 and engaging only the edges of the board with, for example rolling mechanisms or slideways that engage the board. Such a device would have an eraser mounted to the body, as in the second embodiment. Rather than using a cylindrical hinge body with a slot extending through the body to accommodate the board, the hinge body could be asymmetrical about the hinge's rotation axis, with the board sliding across an upper surface of the hinge through the hinge axis. Instead of moving the board with respect to the hinge by translational movement, the board could be rotated about an axis perpendicular to the hinge rotation axis, e.g. in the plane of the board.

Another alternative is to allow board 300 to slide completely through the hinge and be removed from the hinge. The board 300 could then be flipped over when it is located outside of the hinge, and subsequently re-inserted into the hinge. If an automatic eraser is desired in such an embodiment, an eraser surface can be provided on one or both sides of the hinge 200 or on the base 100. If eraser material is provided on only one side of the hinge 200, the user may be required to remove the board 300 from the hinge 200 and flip it over to erase a desired side of the board 300.

The invention also contemplates positioning the hinge 200 at locations on the base other than the end. For example, the hinge 200 can be located at the midpoint of a larger base 100 such that the board 300 is rotated and/or slid between a first use position on one side of the hinge and a second use position on the other side of the hinge, with either work surface facing upwardly in either position. A storage compartment could be disposed on either or both sides of the hinge, to be covered by the board in either or both use positions.

In the illustrated embodiments, board 300 and work surfaces 311, 321 are generally rectangular and planar. However, it is contemplated that the board and/or the work surfaces can be constructed in different shapes and sizes and can also be non-planar, such as an arcuate shape. In addition, the board can be made from materials other than molded plastic, such as lightweight metal, ceramic, wood, etc.

In the illustrated embodiment, the work surfaces are dry-erase marker surfaces. However, many other suitable work surfaces will be apparent to the artisan. Thus either work surface could be, for example, a chalk board, a white board or other material suitable for drawing with markers, a magnetic board, paper, or a material suitable for adhesion by stickers (adhesive stickers and/or sheet vinyl shapes). The two work surfaces can be any combination of these surfaces. The properties of the work surface can also be combined.

For example, by using a smooth white board surface with a ferromagntic backing, the work surface can be used with dry-erase markers, magnetic objects, and vinyl sheet elements.

The art supplies, drawing implements or other tools for applying decorations or other visual indications to the work surfaces are readily selectable by the artisan to correspond to the work surface. Thus, dry-erase markers could be used with a white board, chalk with a chalk board, pencil with a paper surface, magnetized items with a ferromagnetic work surface (and ferromagnetic objects used with a magnetized work surface), and vinyl sheet elements or stickers with any smooth work surface. Other materials could include fabric, crayons, hook and loop attachable material, roller wheels, and many other writing, drawing and creating implements.

The eraser is also selectable by the artisan to be appropriate for the work surface and the materials or objects to be applied to the work surface, for example a felt or foam eraser for dry erase marker on white board, rubber for pencil on paper, a scraper for magnetic objects or stickers, etc. The biasing material 411,421 for the eraser 400 can also include various configurations, including coil springs, leaf springs, elastic blocks, etc.

Another suitable work surface is the magnetic drawing surface, sold under the trademark "MAGNA DOODLE" by Fisher-Price, Inc. and illustrated in U.S. Pat. No. 4,143,472 to Murata, in which a viscous dispersing fluid contained between two transparent or translucent sheets and compartmentalized in a hexagonal grid is loaded with color-contrasting magnetic particles. The user can apply a magnetic stylus to the either surface to pull the magnetic particles to the surface of the fluid to create a visual indication. This surface can be "erased" by passing a magnet across the entire surface to pull the magnetic particles uniformly to either of the two surfaces.

What is Claimed is:

1. Apparatus, comprising:

a base;

a hinge coupled to said base for rotation about a hinge axis through a first range of motion; and a board mounted to said hinge for movement through a second range of motion with respect to said hinge such that said board can translate through said hinge.

2. The apparatus of claim 1, wherein said board is disposable in a first use position in which said board is disposed on said base when said hinge is in a first rotational position defining a first end of said first range of motion and said board is in a first hinge position with respect to said hinge defining a first end of said second range of motion.

3. The apparatus of claim 2, wherein said base includes a storage compartment for storing art supplies and said board covers said storage compartment when said board is in said first use position.

4. The apparatus of claim 2, wherein said board includes a first work surface disposed on a first face of said board and a second work surface disposed on a second, opposite face of said board.

5. The apparatus of claim 4, wherein said first range of motion is bounded by a second rotation position separated approximately 180° from said first rotation position, said board being movable between said first use position in which said first work surface is facing away from said base and a second use position in which said board is disposed on said base, said hinge is in said second rotation position, and said board is in a second hinge position with respect to said hinge defining a second end of said second range of motion.

6. The apparatus of claim 5, wherein said board translates with respect to said hinge, said second range of motion is approximately equal to the length of said board, and said board is supported by said hinge at a first end of said board in said first hinge position and at an opposite, second end of said board in said second hinge position.

7. The apparatus of claim 6, wherein said hinge includes a slot therethrough in which said board is slidably mounted.

8. The apparatus of claim 1, wherein said board is coupled to said hinge for sliding translational movement.

9. The apparatus of claim 1, wherein said board includes a work surface on which erasable designs can be created, and further comprising an eraser suitable for removing said erasable designs, said eraser being coupled to said hinge and disposed to contact said work surface and erase said erasable designs when said board translates with respect to said axis.

10. The apparatus of claim 9, wherein said hinge includes a transverse slot therethrough, said board is mounted for sliding motion through said slot, and said eraser is disposed adjacent said slot.

11. The apparatus of claim 1, wherein said board includes a work surface on which erasable designs can be created, and further comprising an eraser suitable for removing said erasable designs, said eraser being mounted in operative relationship with said board to contact said work surface and erase said erasable designs when said board is moved.

12. The apparatus of claim 11, wherein said eraser is mounted to said base.

13. The apparatus of claim 11, wherein said eraser is mounted to said hinge and is disposed to erase said erasable designs when said board is moved with respect to said hinge.

14. The apparatus of claim 1, wherein said base includes a first end and a second end and said hinge is mounted to said base at said first end.

15. The apparatus of claim 1, further comprising art supplies attachable to said base.

16. A method of using a creation board that is connected to a base by a hinge, comprising the steps of:

creating a design on a work surface of said creation board;

rotating said creation board with respect to said base portion about said hinge; and translating said creation board freely through said hinge.

17. The method of claim 16, further comprising the step of erasing said design from said creation board simultaneously with said step of translating said creation board with respect to said hinge.

18. The method of claim 17, wherein said step of erasing said design from said creation board includes disposing an erasing surface in operative engagement with said work surface and sliding said work surface across said erasing surface.

19. The method of claim 16, wherein said step of creating a design comprises drawing a design with a drawing tool.

20. The method of claim 16, wherein said step of translating includes translating said board with respect to said hinge.

21. The method of claim 16, wherein said board has a second work surface and further comprising the step of creating a design on said second work surface.

22. The method of claim 16 wherein said board includes first and second work surfaces, said creating step includes creating a design on said first work surface when said board is in a first use position in which said board is supported on said base with said first work surface facing away from said base, and said steps of rotating and translating result in moving the board from said first use position to a second use position in which said board is supported on said base in approximately the same position as in said first use position and with said second work surface facing away from said base.

23. An apparatus, comprising:

a base having first and second ends;

a board having a first surface and a second surface for receiving designs and being connected to said base;

means for rotating said board with respect to said base; and means for translating said board with respect to said base and freely through said means for rotating.

24. The apparatus of claim 23, wherein said board is disposable in a first use position with respect to said base in which said first surface faces away from said base, and a second use position in which said board is in approximately the same location on the base as in the first use position, and is inverted so that said second surface faces away from said base.

25. The apparatus of claim 24, wherein said base includes a storage compartment and said board covers said storage compartment when in said first and second use positions.

26. The apparatus of claim 23, further comprising an eraser attached to at least one of said base and said means for rotating and disposed to contact said board to erase erasable designs applied thereto.

27. The apparatus of claim 23, further comprising means coupled to said base for removing from said board designs applied to said board.

28. The apparatus of claim 27, wherein said means for removing includes an erasing member having a felt erasing surface thereon.

29. The apparatus of claim 23, wherein said means for rotating is attached to one of said first and second ends of said base.

30. The apparatus of claim 23, wherein said board intersects with said base rotational axis.

31. Apparatus, comprising:

a base having a left side and a right side;

a hinge located on said base, said hinge having a first portion located adjacent said left side of said base and a second portion located adjacent said right side of said base; and a board mounted to said hinge such that said board can rotate and translate with respect to said base, wherein said first portion and second portion of said hinge are configured such that said board can freely translate with respect to said hinge from a first position at which said board intersects with said hinge axis to a second different translated position at which said board intersects said hinge axis.

* * * * *